US010254086B2

(12) United States Patent
Ballesteros Casas

(10) Patent No.: US 10,254,086 B2
(45) Date of Patent: Apr. 9, 2019

(54) ARMORED SHIRT

(71) Applicant: C.I.A. Miguel Caballero SAS, Bogota, D.C. (CO)

(72) Inventor: Carolina Ballesteros Casas, Bogota (CO)

(73) Assignee: C.I.A. Miguel Caballero SAS, Bogota (CO)

( * ) Notice: Subject to any disclaimer, the term of this patent is extended or adjusted under 35 U.S.C. 154(b) by 323 days.

(21) Appl. No.: 15/193,845

(22) Filed: Jun. 27, 2016

(65) Prior Publication Data

US 2017/0097210 A1 Apr. 6, 2017

Related U.S. Application Data

(63) Continuation-in-part of application No. 13/916,289, filed on Jun. 12, 2013, now abandoned.

(51) Int. Cl.

| | |
|---|---|
| ***F41H 1/02*** | (2006.01) |
| ***A41D 27/20*** | (2006.01) |
| ***A41B 9/12*** | (2006.01) |

(52) U.S. Cl.

CPC ..... *F41H 1/02* (2013.01); *A41B 9/12* (2013.01); *A41D 27/20* (2013.01)

(58) Field of Classification Search

CPC ..... F41H 5/08; F41H 1/02; F41H 1/00

See application file for complete search history.

(56) References Cited

U.S. PATENT DOCUMENTS

| | | | | | |
|---|---|---|---|---|---|
| 4,535,478 | A * | 8/1985 | Zufle | A41D 13/015 | 2/2.5 |
| 4,578,821 | A * | 4/1986 | Zufle | F41H 1/02 | 2/106 |
| 4,578,828 | A * | 4/1986 | Smith, Sr. | A41D 1/065 | 2/234 |
| 5,073,985 | A * | 12/1991 | Stone | F41H 1/02 | 2/2.5 |
| 5,832,536 | A * | 11/1998 | Kramer | A41B 9/06 | 2/69 |
| 6,098,196 | A * | 8/2000 | Logan | F41H 1/02 | 2/2.5 |
| 8,191,170 | B2 * | 6/2012 | Ehlme | A41D 13/012 | 2/2.15 |

(Continued)

*Primary Examiner* — Andrew W Sutton

(74) *Attorney, Agent, or Firm* — Thomas P. O'Connell; O'Connell Law Firm

(57) ABSTRACT

An armored shirt with contoured body armor selectively inserted into contoured armor pockets. Front and rear portions are connected along lateral edges. Shoulder portions connect upper portions of the front and rear portions, and neck and left and right arm openings are defined by the front, rear, and shoulder portions. Contoured armor pockets are formed in the front and rear portions with inner and outer layers of material joined to define a contoured edge shape while leaving a pocket opening. The contoured edge shapes of the body armor and the armor pocket correspond with both spanning from under the left arm opening to under the right arm opening. The edge shape of the pocket and the armor can include lateral inwardly arcuate upper narrowing underarm portions adjacent to the arm openings and a central inwardly arcuate upper portion therebetween bounded by the neck opening.

20 Claims, 8 Drawing Sheets

(56) References Cited

U.S. PATENT DOCUMENTS

| | | | | |
|---|---|---|---|---|
| 8,555,412 | B2 * | 10/2013 | Aquino | F41H 1/02 2/2.5 |
| 8,561,214 | B2 * | 10/2013 | Turner | A41D 13/0156 2/267 |
| 8,925,115 | B1 * | 1/2015 | Hanna | F41H 1/02 2/102 |
| 2003/0101508 | A1 * | 6/2003 | Marshall | A41D 13/0012 2/462 |
| 2006/0162043 | A1 * | 7/2006 | Angus | A41D 1/04 2/113 |
| 2010/0100994 | A1 | 4/2010 | Ehlme | |
| 2010/0313321 | A1 * | 12/2010 | Carlson | F41H 1/02 2/2.5 |
| 2011/0131694 | A1 * | 6/2011 | Fearon | F41H 1/02 2/2.5 |
| 2012/0216327 | A1 | 8/2012 | Turner | |
| 2013/0152290 | A1 * | 6/2013 | Chou | A41D 13/0575 2/463 |
| 2013/0263363 | A1 * | 10/2013 | Pietrzak | A42B 3/28 2/411 |
| 2014/0201878 | A1 * | 7/2014 | Ballesteros Casas | F41H 1/02 2/2.5 |
| 2015/0059042 | A1 * | 3/2015 | Aquino | F41H 1/02 2/2.5 |

* cited by examiner

ARMORED SHIRT

RELATED APPLICATION

This application is a continuation-in-part of U.S. patent application Ser. No. 13/916,289, filed Jun. 12, 2013, which claimed priority to Colombian Patent Application No. 12-98329 filed Jun. 12, 2012, the entirety of each being incorporated herein by reference.

FIELD OF THE INVENTION

This invention relates to the field of personal protection by means of armored clothing. It is particularly related to a shirt, namely a tank top undershirt, with removable, contoured armor selectively retained within correspondingly contoured pockets to protect substantially the entire trunk of a human wearer's body against attacks, such as firearm attacks.

BACKGROUND OF THE INVENTION

Within the area of personal and individual protection against attacks with firearms, bladed weapons, and even inflammatory artifacts, great breakthroughs have been developed with the aim of providing clothing intended to be light and comfortable and easy to carry while providing a high level of protection. Perhaps the best known articles are bulletproof vests.

Nonetheless, such vests are commonly characterized as being uncomfortable and heavy. Moreover, vests typical to the prior art are worn in plain sight, which may not be comforting to observers.

SUMMARY OF THE INVENTION

There is thus a recognized need in the art for body armor that is light, comfortable, impermeable clothing that can be worn in a substantially unnoticeable manner thereby to be concealed from public sight. The invention disclosed herein meets these needs by providing an article of clothing wearable as an undershirt, namely a tank top undershirt, with anterior and posterior contoured pockets selectively retaining correspondingly contoured body armor to protect the torso of the wearer.

DETAILED DESCRIPTION OF PREFERRED EMBODIMENTS

Figure 1:
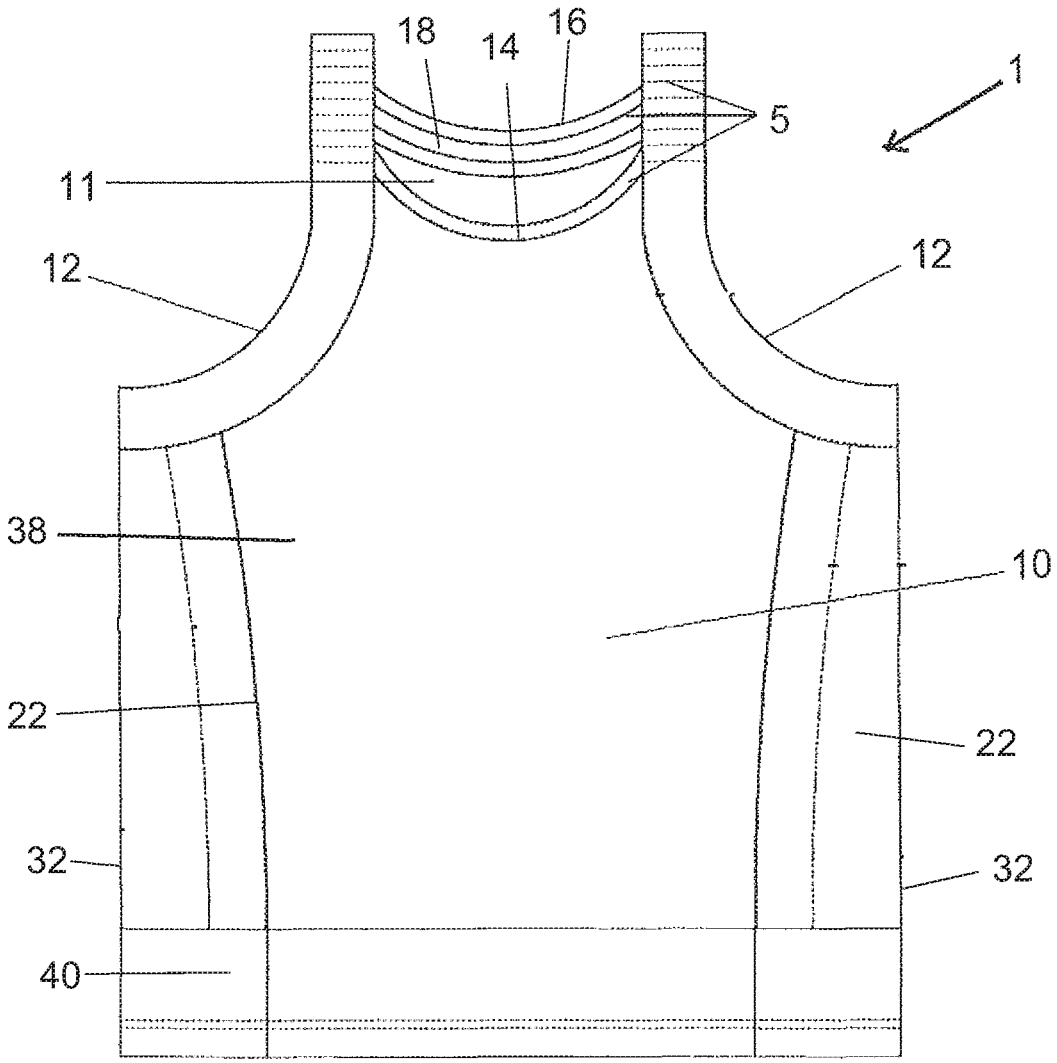
FIG. 1 is a view in front elevation of an armored shirt according to the invention.

Armored shirts as disclosed herein are subject to a wide variety of embodiments. However, to ensure that one skilled in the art will be able to understand and, in appropriate cases, practice the present invention, certain preferred embodiments of the broader invention revealed herein are described below and shown in the accompanying drawing figures.

Looking more particularly to the drawings, an armored shirt according to the invention is indicated generally at 1 in FIGS. 1 through 8. There, the shirt 1 has the overall configuration of a tank top undershirt. The armored shirt 1 has a front portion 10 and a rear portion 20. The front portion 10 and the rear portion 20 are joined along lateral edges thereof, and shoulder straps connect upper ends of the front portion and the rear portion 20. The shoulder straps are reinforced and stitched to comprise non-stretch members.

A neck opening 11 is disposed between the front portion 10 and the rear portion 20 of the shirt 1. The neck opening 11 is bounded anteriorly and posteriorly by arcuate, central upper ends of the front and rear portions 10 and 20 and laterally by inner edges of the shoulder straps. Left and right arm openings 12 are bounded by arcuate, upper lateral edges of the front and rear portions 10 and 20 and by outer edges of the shoulder straps. Reinforcement fabric 5 is disposed on the neck opening 11 and on the sides the arm openings 12.

Figure 7:
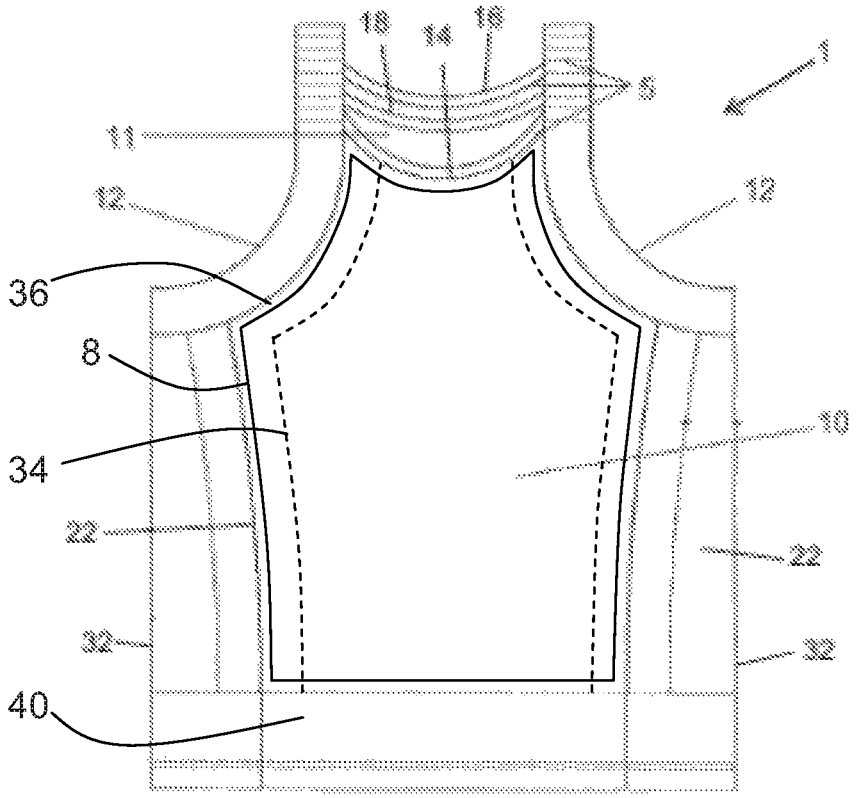
FIG. 7 is a view in front elevation of the armored shirt with the outer panel of the anterior pocket removed to illustrate the contoured body armor retained therein and the positioning and retention flaps of the anterior pocket.

As can be understood with combined reference to FIGS. 1 and 7, for example, the front portion 10 of the armored shirt 1 has at least two fabric layers, namely an inner layer 36 and an outer layer 38, that together define an anterior armor pocket 14 for selectively receiving a contoured panel of body armor 8. The inner and outer layers 36 and 38 are made of fabric. The inner and outer layers 36 and 38 are joined, such as by sewed stitching or any other method or combination thereof, at their lower ends where they are bounded by a lower band 40, at their lateral edges and along arcuate paths that broaden from lower to upper portions thereof by side zones 22, and at lateral arcuate upper narrowing underarm portions where they are bounded by the arm openings 12. The inner and outer layers 36 and 38 are not joined and are thus open along a central arcuate upper portion between the lateral arcuate upper narrowing portions bounded by the neck opening 11. The anterior armor pocket 14 thus has a contoured shape with a lower edge, lateral edges broadening from lower to upper portions thereof, lateral inwardly arcuate upper narrowing underarm portions, and an open central inwardly arcuate upper portion between the inwardly arcuate upper narrowing underarm portions.

As shown in FIG. 7, the anterior pocket 14 has armor retaining flaps 34 therewithin. The armor retaining flaps 34 in this embodiment comprise lateral armor retaining flaps 34 that traverse along the lateral edges and along the lateral inwardly arcuate upper narrowing arm portions of the pocket 14. The flaps 34 can be secured at their outer edges to the edges of the anterior pocket 14 and at their upper and lower ends to the inner layer 36. The armor retaining flaps 34 have a generally consistent width and follow the contour of the lateral edges and the lateral inwardly arcuate upper narrowing arm portions. The armor retaining flaps 34 thus have portions that communicate longitudinally adjacent to the lateral edges of the pocket 14 and arcuate underarm portions that communicate along the lateral inwardly arcuate upper narrowing underarm portions of the shirt 1.

The armor retaining flaps 34 can be formed of a flexible material having greater rigidity than the fabric forming the inner and outer layers 36 and 38. By way of example and not limitation, where the inner and outer layers 36 and 38 may each be formed from a single layer of thin material, such as mesh, the armor retaining flaps 34 could be formed from a thicker material or multiple layers of material, such as neoprene.

As best seen in FIG. 7, a panel of body armor 8 with a contoured edge can be selectively disposed in the anterior pocket 14. The panel of body armor 8 has a contoured edge shape corresponding to the contoured shape of the anterior pocket 14. Like the anterior pocket 14, the body armor 8 has a contoured shape with a lower edge, lateral edges broadening from lower to upper portions thereof, lateral inwardly arcuate upper narrowing underarm portions, and a central inwardly arcuate upper portion between the inwardly arcuate upper narrowing underarm portions. In lateral and longitudinal dimensions, the panel of body armor 8 can be sized to be slightly smaller than, generally equal to, or perhaps slightly larger than the corresponding portions of the anterior pocket 14.

The panel of body armor 8 could have a single layer or multiple layers of attack resistant material, such as ballistic and/or stab resistant material, of any type that may now exist or hereafter be developed. The material of the body armor 8 can be flexible. Non-limiting examples of flexible armor material include aramid fiber cloth materials, such as the material sold under the registered trademark KEVLAR by E.I. duPont deNemours and Co., Inc. and high molecular weight polyethylene filament materials in a flexible resin matrix, such as the material sold under the trademark SPECTRA SHIELD™ by Allied Signal, Inc. of Morristown, N.J.

With the anterior pocket 14 and the panel of body armor 8 having correspondingly contoured shapes and sizes, the panel of body armor 8 can be selectively inserted into the anterior pocket 14 with the corresponding shapes of the armor 8 and the pocket 14 aligned. More particularly, the lower edges, the lateral edges broadening from lower to upper portions thereof, the lateral inwardly arcuate upper narrowing underarm portions, and the central inwardly arcuate upper portions between the inwardly arcuate upper narrowing underarm portions can be disposed to align as in FIG. 7. With that, the body armor 8 and the armored shirt 1 in general can provide ballistic, stab, and/or other protection to substantially the whole thorax and abdominal region of the user. The underarm portions of the body armor 8 can curve under the wearer's arms and provide closely aligned protection thereto, and the portions of the body armor 8 adjacent to the lateral edges can provide broadening protection to the abdomen and the typically broadened chest of the wearer. The body armor 8 can be disposed with its lateral edges tucked under the armor retaining flaps 34 and against the inner layer 36 of the pocket 14 so that the flaps 34 securely retain the body armor 8 in alignment with the anterior pocket 14 and in proximity to the wearer's body to ensure continued optimal comfort and protection to the wearer.

Figure 2:
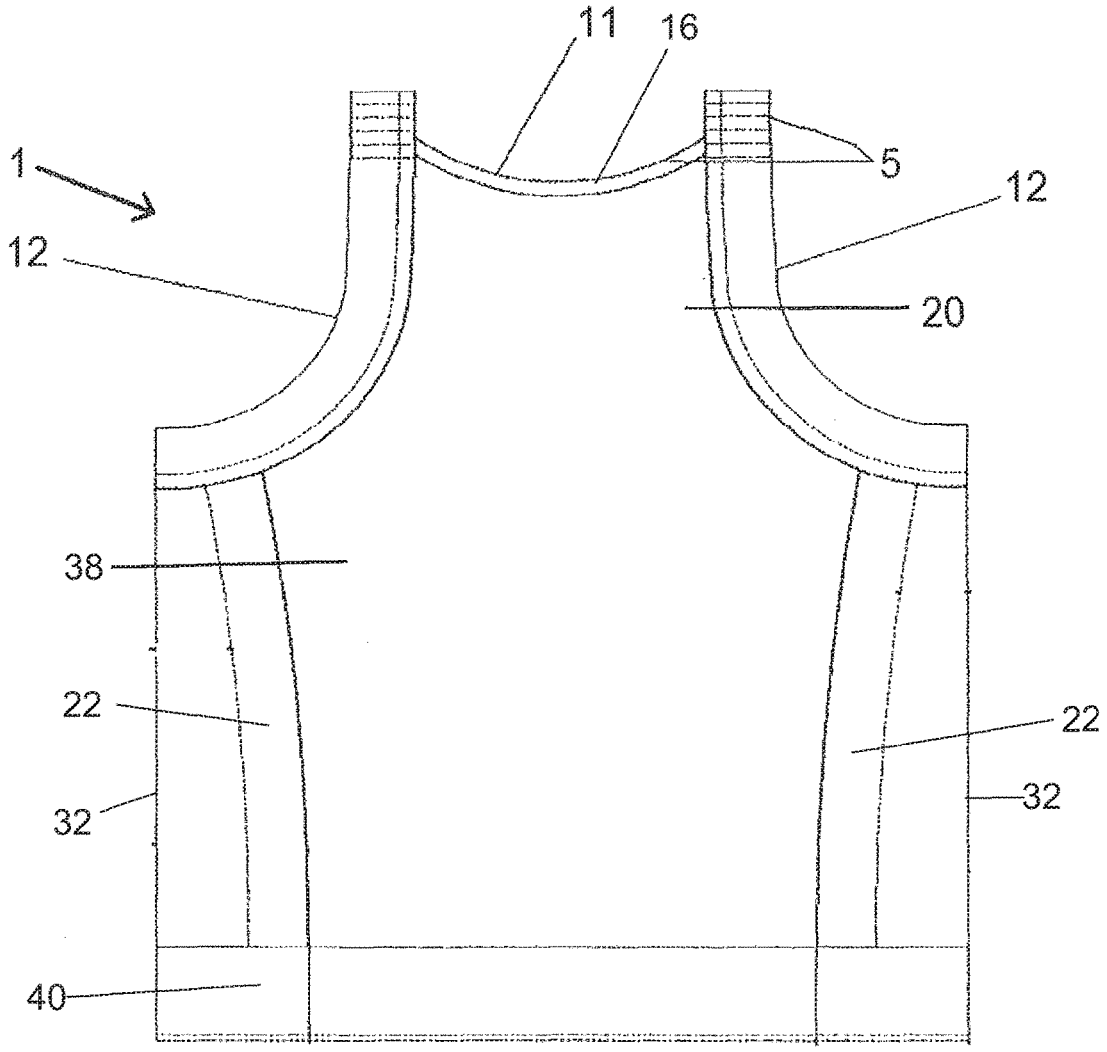
FIG. 2 is a view in rear elevation of the armored shirt of FIG. 1.
Figure 8:
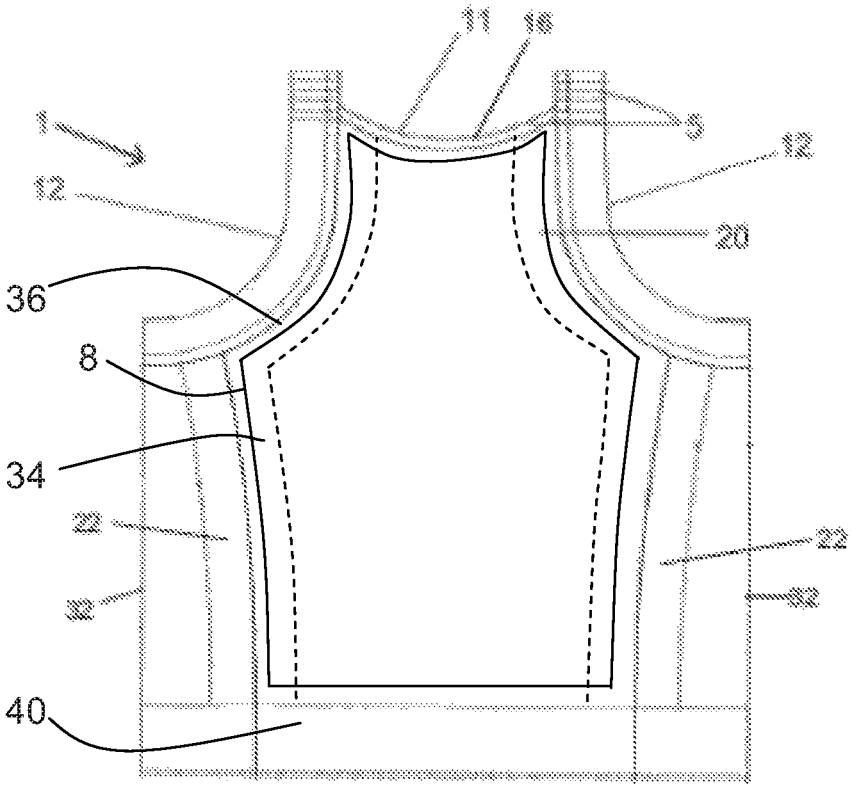
FIG. 8 is a view in rear elevation of the armored shirt with the outer panel of the posterior pocket removed to illustrate the contoured body armor retained therein and the positioning and retention flaps of the posterior pocket.

The rear portion 20 of the shirt can be better understood with additional reference to FIGS. 2 and 8. The rear portion 20 of the armored shirt 1 is composed of at least two fabric layers, again comprising an inner layer 36 and an outer layer 38, that together define a posterior armor pocket 16 for selectively receiving a contoured panel of body armor 8. The inner and outer layers 36 and 38 again can be made of fabric. The inner and outer layers 36 and 38 are joined, such as by sewed stitching or any other method or combination thereof, at their lower ends where they are bounded by a lower band 40, at their lateral edges and bounded along arcuate paths that broaden from lower to upper portions thereof by side zones 22, and at lateral arcuate upper narrowing underarm portions where they are bounded by the arm openings 12. The inner and outer layers 36 and 38 are not joined and are thus open along a central arcuate upper portion between the lateral arcuate upper narrowing portions bounded by the neck opening 11. The posterior armor pocket 16 thus has a contoured shape with a lower edge, lateral edges broadening from lower to upper portions thereof, lateral inwardly arcuate upper narrowing underarm portions, and an open central inwardly arcuate upper portion between the inwardly arcuate upper narrowing underarm portions.

As shown in FIG. 8, the posterior pocket 14 has armor retaining flaps 34 therewithin. The armor retaining flaps 34 in this embodiment comprise lateral armor retaining flaps 34 that traverse along the lateral edges and along the lateral inwardly arcuate upper narrowing arm portions of the pocket 16. The armor retaining flaps 34 have a generally consistent width and follow the contour of the lateral edges and the lateral inwardly arcuate upper narrowing arm portions. The flaps 34 can be secured at their outer edges to the edges of the anterior pocket 14 and at their ends to the inner layer 36 of the pocket 16. The armor retaining flaps 34 thus have portions that communicate longitudinally adjacent to the lateral edges of the pocket 16 and arcuate underarm portions that communicate along the lateral inwardly arcuate upper narrowing underarm portions. The armor retaining flaps 34 can be formed of a flexible material having greater rigidity than the fabric forming the inner and outer layers 36 and 38. By way of example and not limitation, where the inner and outer layers 36 and 38 are formed from a single layer of thin material, such as mesh, the armor retaining flaps 34 could be formed from a thicker material or multiple layers of material, such as neoprene.

As best seen in FIG. 8, a panel of body armor 8 with a contoured edge can be selectively disposed in the posterior pocket 14. The panel of body armor 8 has a contoured edge shape corresponding to the contoured shape of the posterior pocket 16. Like the posterior pocket 16, the body armor 8 has a contoured shape with a lower edge, lateral edges broadening from lower to upper portions thereof, lateral inwardly arcuate upper narrowing underarm portions, and a central inwardly arcuate upper portion between the inwardly arcuate upper narrowing underarm portions. The panel of body armor 8 could have a single layer or multiple layers of attack resistant armor material, such as ballistic and/or stab resistant material, of any type that may now exist or hereafter be developed. The material of the body armor 8 can be flexible. In lateral and longitudinal dimensions, the panel of body armor 8 can be sized to be slightly smaller than, generally equal to, or perhaps slightly larger than the corresponding portions of the posterior pocket 16.

With the posterior pocket 16 and the panel of body armor 8 having correspondingly contoured shapes and sizes, the panel of body armor 8 can be selectively inserted into the posterior pocket 16 with the corresponding shapes of the armor 8 and the pocket 16 aligned. More particularly, the lower edges, the lateral edges broadening from lower to upper portions thereof, the lateral inwardly arcuate upper narrowing underarm portions, and the central inwardly arcuate upper portions between the inwardly arcuate upper narrowing underarm portions can be disposed to align as in FIG. 8. With that, the body armor 8 can provide ballistic, stab, and/or other protection to substantially the entire back of the wearer. The underarm portions of the body armor 8 can curve under the wearer's arms and back and provide closely aligned protection thereto, and the portions of the portions of the body armor 8 adjacent to the lateral edges can provide broadening protection to the wearer's sides and typically broadened upper back. The body armor 8 can be disposed with its lateral edges tucked under the armor retaining flaps 34 and against the inner layer 36 of the pocket 16 so that the flaps 34 securely retain the body armor 8 in alignment with the posterior pocket 16 and in proximity to the wearer's body to ensure continued optimal comfort and protection to the wearer.

Figure 3:
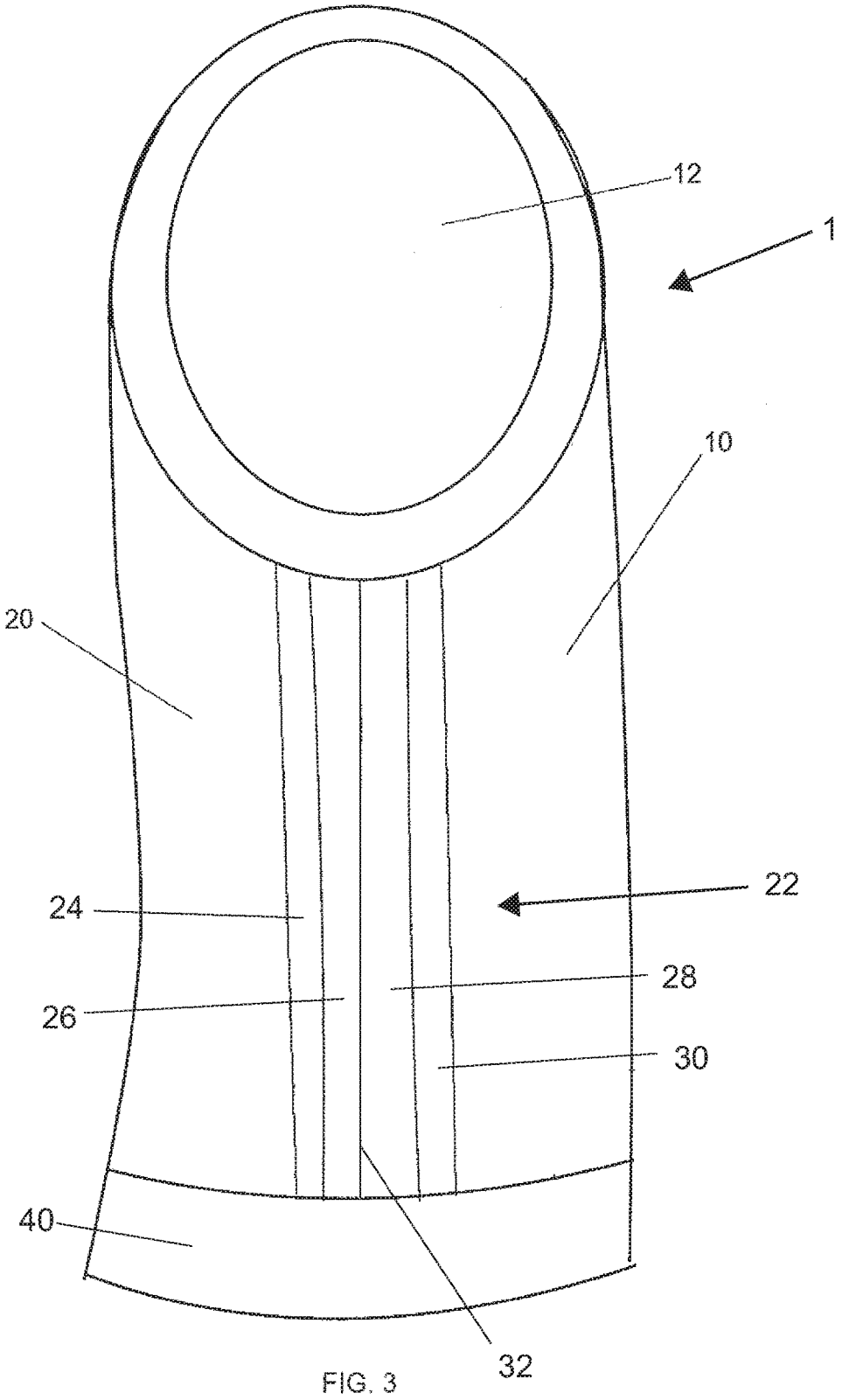
FIG. 3 is a view in left side elevation of the armored shirt of FIG. 1.
Figure 4:
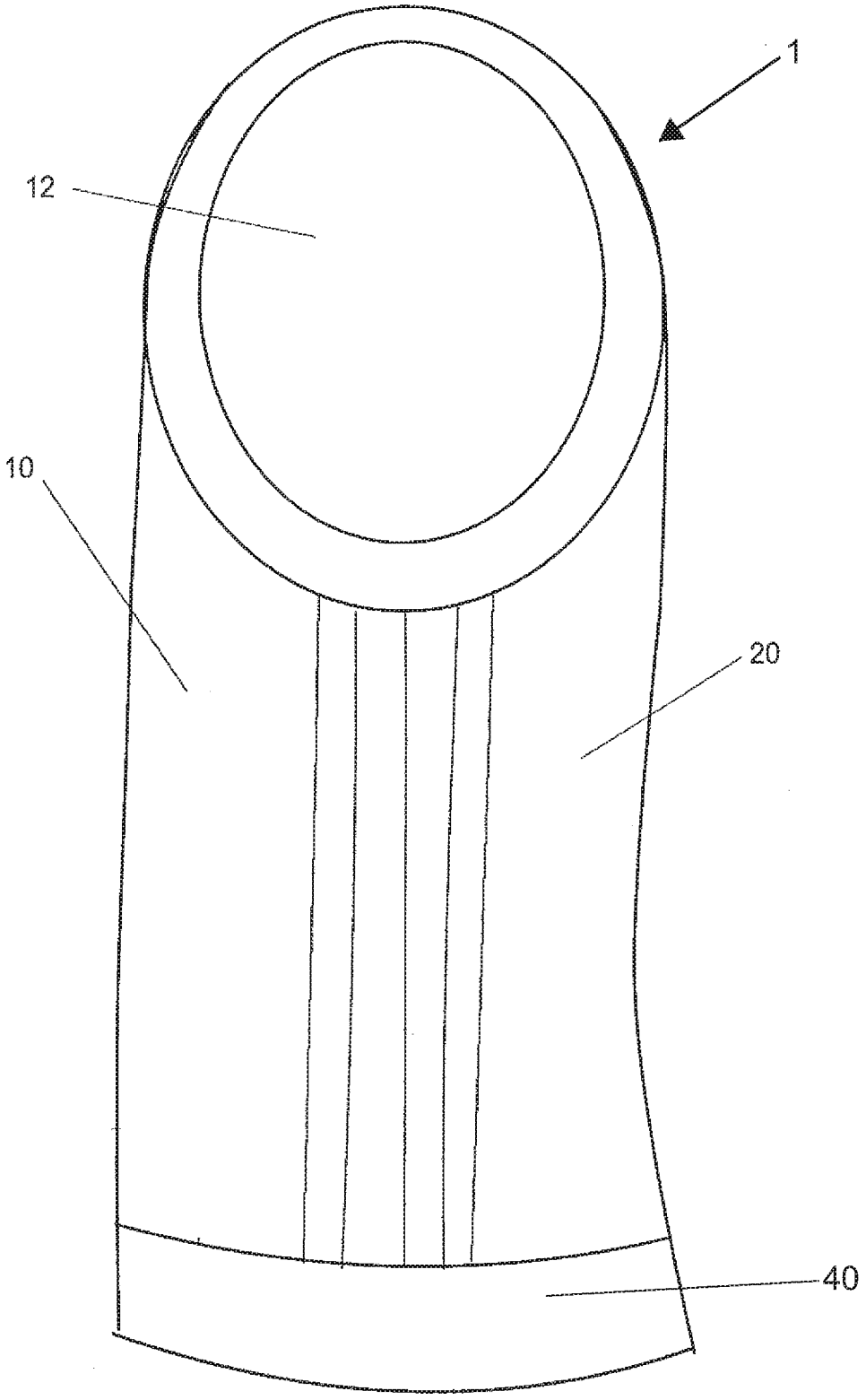
FIG. 4 is a view in right side elevation of the armored shirt of FIG. 1.

FIGS. 3 and 4 shown left and right views of the armored shirt 1. There, one can perceive that longitudinal side zones 22 are interposed between the front portion 10 and the back portion 20 of the shirt 1. Each side zone is formed by four strips 24, 26, 28, 30 made of fabric which depend longitudinally from the lower portion of the arm openings 12 and extend to the lower band 40, which may or may not be continuous. A posterior strip 24 is attached to an edge of the rear portion 20 to communicate longitudinally, and an anterior strip 30 is attached to an edge of the front portion 10 to communicate longitudinally. The other longitudinal edges of the strips 24 and 30 are respectively attached to two central strips 26 and 28 made of fabric. The two central strips 26 and 28 are selectively joined to one another on the remaining longitudinal edges by an invisible zipper 32, such as a No. 2, 25 cm invisible zipper as sold by the YKK Corporation of Tokyo, Japan under the registered trademark YKK. This structure provides the armored shirt 1 simultaneously with resistance and elasticity so that the shirt 1 is well adapted to the body of the user. Moreover, the strips 26 and 28 and, ultimately, the front and back portions 10 and 20 of the armored shirt 1 can be readily separated by unzipping the zipper 32 to facilitate, among other things, application and removal of the armored shirt 1.

Figure 5:
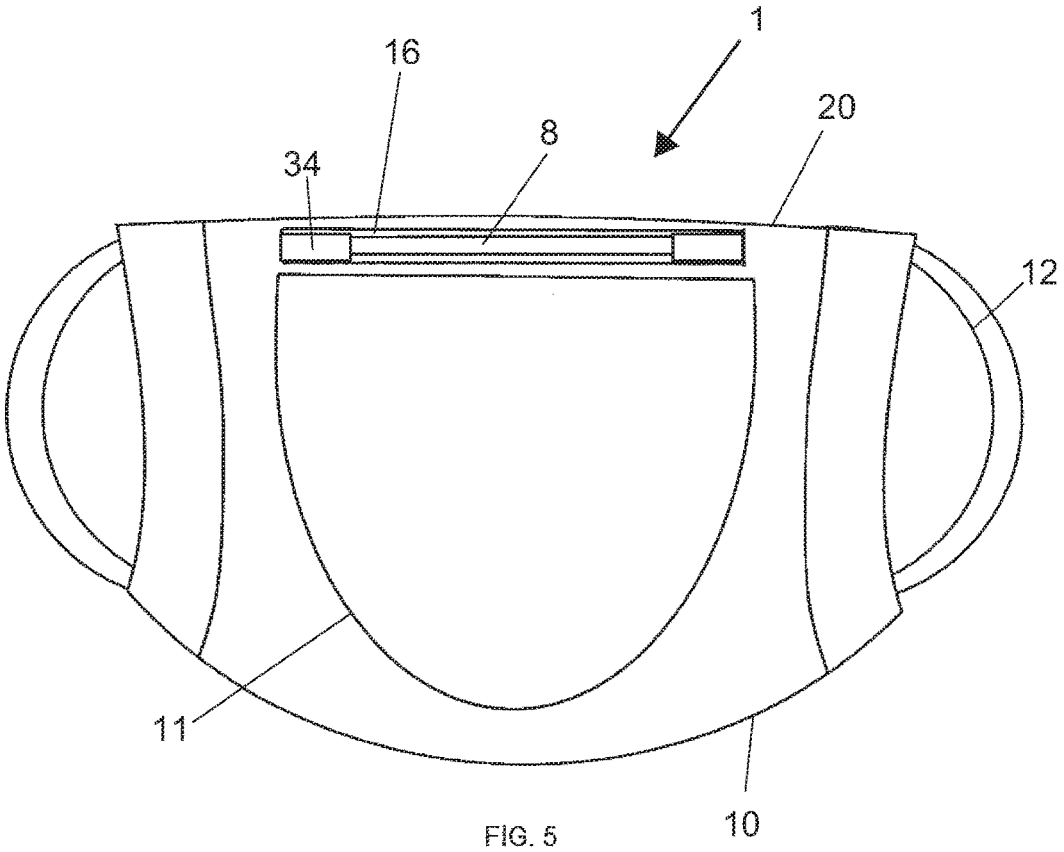
FIG. 5 is a top plan view of the armored shirt of FIG. 1.
Figure 6:
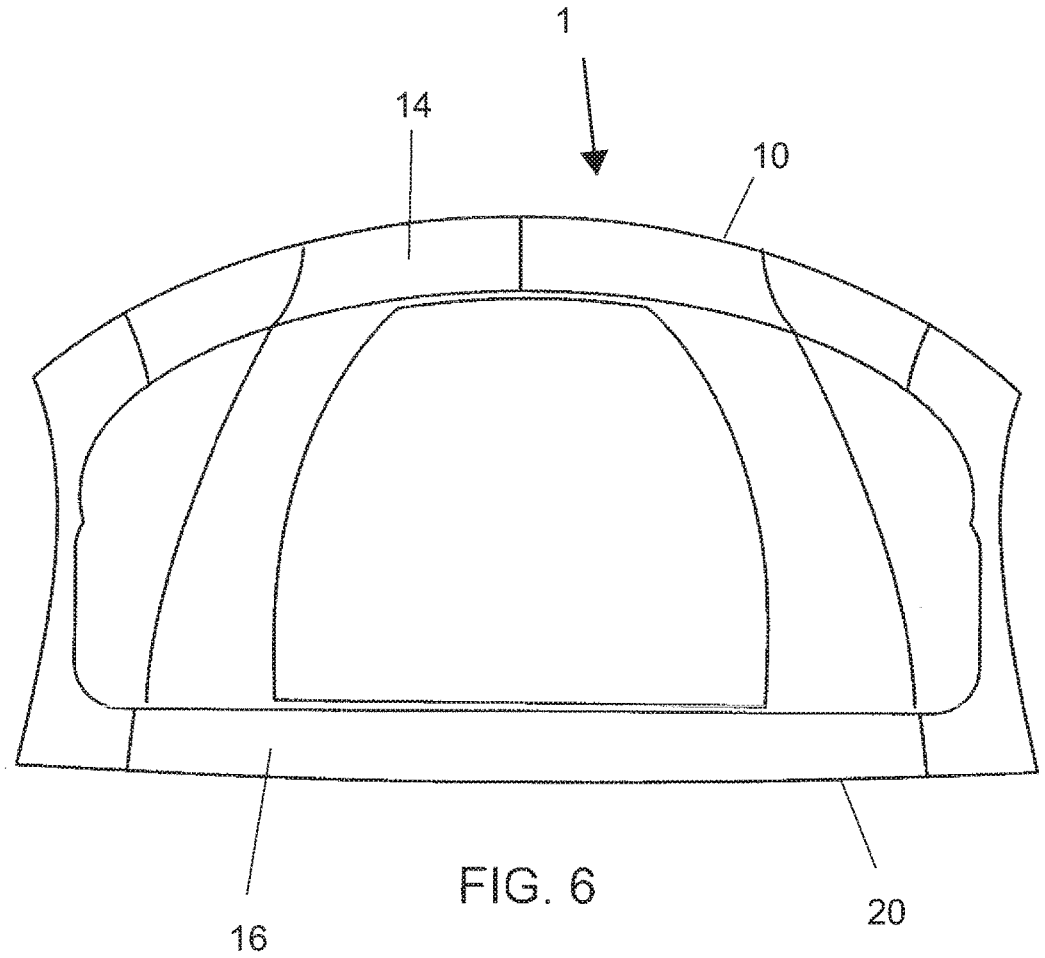
FIG. 6 is a bottom plan view of the armored shirt of FIG. 1.

FIGS. 5 and 6 show top and bottom views of the armored shirt 1 as it fits when being worn. The neck opening 11 and the arm openings 12 can be perceived. The opening 11 for the head of the user is illustrated to be delimited by the strips for the shoulders of the user, the front portion 10, and the back portion 20. On the strips for the shoulders, one can see an outmost strip which is a reinforcement delimiting and bounding the arm openings 12. The posterior pocket 16 can be perceived with a panel of body armor 8 retained therein and held in place by armor retaining flaps 34.

The armored shirt 1 has been researched, developed, and designed using state-of-the-art materials so that the final product is durable and comfortable while providing protection and discretion to the wearer. The material defining the neck opening 11 and the arm openings 12 in preferred embodiments is a ribbed, knitted fabric with 50% polyester and 50% cotton 228±11 g×m$^2$. The material of the front portion 10 and the back portion 20 may be a Powernet type mesh, which is a knitted fabric with 14% Elastane and 86% Nylon 330±23 g×m$^2$. The zones 22 of the sides of the armored shirt 1 may be made of a material composed of knitted fabric with 16% Elastane and 84% Nylon 186±9 g×m$^2$ and with a fabric 3D internal fabric of 100% Polyester.

The panels of armor 8 are selectively removable. This enables, among other things, that the armored shirt 1 can be readily washed at home without special care that may render washing problematic. The design and the material used have been selected thinking of the constant use and moisture produced by the body.

The armor panels 8 are, in preferred embodiments, ultrasonically sealed and made of impermeable material. With that, the armor panels 8 are protected from moisture produced by the body of the user and other deleterious environmental impacts.

With certain details and embodiments of the present invention for an armored shirt 1 disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, any such claims shall be construed to cover not only the corresponding structure and material expressly described in this specification but also all equivalents thereof.

I claim as deserving the protection of Letters Patent:

1. An armored shirt comprising:

a front portion and a rear portion wherein the front portion and the rear portion are connected along lateral edges thereof;

shoulder portions that connect upper portions of the front and rear portions;

a neck opening defined anteriorly and posteriorly by the front and rear portions and laterally by the shoulder portions;

left and right arm openings defined by arcuate, upper edges of the front and rear portions and by outer edges of the shoulder portions;

contoured body armor with a contoured edge shape;

a contoured armor pocket formed in at least the front portion or the rear portion of the armored shirt for receiving the contoured body armor wherein the pocket is formed by an inner layer of material and an outer layer of material, wherein the inner and outer layers of material are joined along lower and lateral portions of the inner and outer layers of material to define a contoured edge shape of the pocket, and wherein the inner and outer layers are not joined along an upper portion thereof thereby to leave a pocket opening;

wherein the contoured edge shape of the contoured body armor substantially correspond to the contoured edge shape of the contoured armor pocket and wherein the contoured edge shape of the contoured armor pocket spans from under the left arm opening to under the right arm opening;

wherein the contoured edge shape of the contoured armor pocket is bounded by a lower edge, at lateral edges, at lateral inwardly arcuate upper narrowing underarm portions adjacent to the arm openings, and along a central upper portion between the lateral inwardly arcuate upper narrowing portions bounded by the neck opening, wherein the central upper portion of the contoured edge shape comprises the pocket opening, and wherein the contoured edge shape of the body armor has a lower edge, lateral edges, lateral inwardly arcuate upper narrowing underarm portions, and a central upper portion between the lateral inwardly arcuate upper narrowing portions;

whereby the contoured body armor can be selectively inserted into the contoured armor pocket with the contoured edge shapes of the contoured body armor and the contoured armor pocket disposed in alignment.

2. The armored shirt of claim 1 wherein the central upper portion of the contoured edge shape of the contoured armor pocket comprises a central inwardly arcuate upper portion and wherein the central upper portion of the contoured edge shape of the contoured body armor comprises a central inwardly arcuate upper portion.

3. The armored shirt of claim 1 wherein the lateral edges of the contoured armor pocket broaden from lower to upper portions of the lateral edges and wherein the lateral edges of the contoured body armor broaden from lower to upper portions of the lateral edges.

4. The armored shirt of claim 1 further comprising armor retaining flaps within the body armor pocket.

5. An armored shirt comprising:

a front portion and a rear portion wherein the front portion and the rear portion are connected along lateral edges thereof;

shoulder portions that connect upper portions of the front and rear portions;

a neck opening defined anteriorly and posteriorly by the front and rear portions and laterally by the shoulder portions;

left and right arm openings defined by arcuate, upper edges of the front and rear portions and by outer edges of the shoulder portions;

contoured body armor with a contoured edge with a shape;

a contoured armor pocket formed in at least the front portion or the rear portion of the armored shirt for receiving the contoured body armor wherein the pocket is formed by an inner layer of material and an outer layer of material, wherein the inner and outer layers of material are joined along lower and lateral portions of the inner and outer layers of material to define a contoured edge structure of the contoured armor pocket with a shape, and wherein the inner and outer layers are not joined along an upper portion thereof thereby to leave a pocket opening; and wherein the shape of the contoured edge of the contoured body armor substantially corresponds to the shape of the contoured edge structure of the contoured armor pocket and wherein the shape of the contoured edge structure of the contoured armor pocket spans from under the left arm opening to under the right arm opening;

armor retaining flaps within the body armor pocket wherein the armor retaining flaps traverse longitudinally along the lateral portions of the inner and outer layers of material that define the contoured edge structure of the pocket and wherein outer edges of the armor retaining flaps are secured to lateral portions of the contoured armor pocket;

whereby the contoured body armor can be selectively inserted into the contoured armor pocket with the shape of the contoured edge of the contoured body armor and the shape of the contoured armor pocket disposed in alignment.

6. The armored shirt of claim 5 wherein the armor retaining flaps are further secured at upper ends of the armor retaining flaps to the inner layer of material.

7. The armored shirt of claim 5 wherein the contoured edge shape of the contoured armor pocket is bounded by a lower edge, at lateral edges, at lateral inwardly arcuate upper narrowing underarm portions adjacent to the arm openings, and along a central upper portion between the lateral inwardly arcuate upper narrowing portions bounded by the neck opening, wherein the central upper portion of the contoured edge shape comprises the pocket opening, and wherein the body armor flaps are additionally secured along the lateral inwardly arcuate upper narrowing underarm portions of the contoured edge shape of the contoured armor pocket.

8. An armored shirt comprising:

a front portion and a rear portion wherein the front portion and the rear portion are connected along lateral edges thereof;

shoulder portions that connect upper portions of the front and rear portions;

a neck opening defined anteriorly and posteriorly by the front and rear portions and laterally by the shoulder portions;

left and right arm openings defined by arcuate, upper edges of the front and rear portions and by outer edges of the shoulder portions;

contoured body armor with a contoured edge shape;

a contoured armor pocket formed in at least the front portion or the rear portion of the armored shirt for receiving the contoured body armor wherein the pocket is formed by an inner layer of material and an outer layer of material, wherein the inner and outer layers of material are joined along lower and lateral portions of the inner and outer layers of material to define a contoured edge shape of the pocket, and wherein the inner and outer layers are not joined along an upper portion thereof thereby to leave a pocket opening;

wherein the contoured edge shape of the contoured body armor substantially correspond to the contoured edge shape of the contoured armor pocket and wherein the contoured edge shape of the contoured armor pocket spans from under the left arm opening to under the right arm opening; and armor retaining flaps within the body armor pocket;

wherein the inner and outer layers are formed from a fabric and wherein the armor retaining flaps are formed of a flexible material having greater rigidity than the fabric forming the inner and outer layers;

whereby the contoured body armor can be selectively inserted into the contoured armor pocket with the contoured edge shapes of the contoured body armor and the contoured armor pocket disposed in alignment.

9. An armored shirt comprising:

a front portion and a rear portion wherein the front portion and the rear portion are connected along lateral edges thereof;

shoulder portions that connect upper portions of the front and rear portions;

a neck opening defined anteriorly and posteriorly by the front and rear portions and laterally by the shoulder portions;

left and right arm openings defined by arcuate, upper edges of the front and rear portions and by outer edges of the shoulder portions;

contoured body armor with a contoured edge shape;

a contoured armor pocket formed in at least the front portion or the rear portion of the armored shirt for receiving the contoured body armor wherein the pocket is formed by an inner layer of material and an outer layer of material, wherein the inner and outer layers of material are joined along lower and lateral portions of the inner and outer layers of material to define a contoured edge shape of the pocket, and wherein the inner and outer layers are not joined along an upper portion thereof thereby to leave a pocket opening; and wherein the contoured edge shape of the contoured body armor substantially correspond to the contoured edge shape of the contoured armor pocket and wherein the contoured edge shape of the contoured armor pocket spans from under the left arm opening to under the right arm opening;

wherein the front portion and the rear portion are connected by a left side zone and a right side zone wherein each of the left side zone and the right side zone comprises at least first and second strips made of fabric that span longitudinally from arm openings to a lower portion of the armored shirt, wherein each strip has first and second longitudinal edges, wherein the first strip is attached along the first longitudinal edge thereof to the front portion and wherein the second strip is attached along the first longitudinal edge thereof to the back portion and further comprising a zipper interposed longitudinally between the second longitudinal edges of the first and second strips;

whereby the contoured body armor can be selectively inserted into the contoured armor pocket with the contoured edge shapes of the contoured body armor and the contoured armor pocket disposed in alignment.

10. The armored shirt of claim 9 wherein the zipper comprises an invisible zipper.

11. The armored shirt of claim 9 wherein the neck opening and the arm openings are formed from ribbed, knitted fabric with 50% polyester and 50% cotton 228±11 g×m$^2$, wherein the material of the front portion and the back portion comprises a knitted fabric mesh with 14% Elastane and 86% nylon 330±23 g×m$^2$, wherein the left and right side zones of the armored shirt comprise knitted fabric with 16% Elastane and 84% nylon 186±9 g×m$^2$ and an internal 3D fabric of 100% polyester.

12. The armored shirt of claim 11 wherein the contoured body armor is ultrasonically sealed and made of impermeable material so that the contoured body armor is protected from moisture.

13. The armored shirt of claim 9 wherein each of the left and right side zones comprises first, second, third, and fourth strips that span longitudinally from the lower zone of the openings for the arms of the user to the lower portion of the armored shirt, wherein the third strip has a first longitudinal edge attached to the second longitudinal edge of the first strip and a second longitudinal edge attached to the zipper, and wherein the fourth strip has a first longitudinal edge attached to the second longitudinal edge of the second strip and a second longitudinal edge attached to the zipper.

14. The armored shirt of claim 9 wherein the contoured body armor is formed from a material comprising at least one of an aramid fiber cloth material or a high molecular weight polyethylene filament material in a resin matrix.

15. An armored shirt comprising:

a front portion and a rear portion wherein the front portion and the rear portion are connected along lateral edges thereof;

shoulder portions that connect upper portions of the front and rear portions;

a neck opening defined anteriorly and posteriorly by the front and rear portions and laterally by the shoulder portions;

left and right arm openings defined by arcuate, upper edges the front and rear portions and by outer edges of the shoulder portions;

contoured body armor with a contoured edge shape;

a contoured armor pocket formed in at least the front portion or the rear portion of the armored shirt for receiving the contoured body armor wherein the pocket is formed by an inner layer of material and an outer layer of material, wherein the inner and outer layers of material are joined along lower and lateral portions of the inner and outer layers of material to define a contoured edge shape of the pocket, and wherein the inner and outer layers are not joined along an upper portion thereof thereby to leave a pocket opening;

wherein the contoured edge shape of the contoured body armor substantially corresponds to the contoured edge shape of the contoured armor pocket and wherein the contoured edge shape of the contoured armor pocket spans from under the left arm opening to under the right arm opening; and wherein the contoured edge shape of the contoured armor pocket is bounded by a lower edge, at lateral edges, at lateral inwardly arcuate upper narrowing underarm portions adjacent to the arm openings, and along a central upper portion between the lateral inwardly arcuate upper narrowing portions bounded by the neck opening, wherein the central upper portion of the contoured edge shape comprises the pocket opening, and wherein the contoured edge shape of the body armor has a lower edge, lateral edges, lateral inwardly arcuate upper narrowing underarm portions, and a central upper portion between the lateral inwardly arcuate upper narrowing portions;

wherein the central upper portion of the contoured edge shape of the contoured armor pocket comprises a central inwardly arcuate upper portion and wherein the central upper portion of the contoured edge shape of the contoured body armor comprises a central inwardly arcuate upper portion;

whereby the contoured body armor can be selectively inserted into the contoured armor pocket with the contoured edge shapes of the contoured body armor and the contoured armor pocket disposed in alignment.

16. The armored shirt of claim 15 wherein the lateral edges of the contoured armor pocket broaden from lower to upper portions of the lateral edges and wherein the lateral edges of the contoured body armor broaden from lower to upper portions of the lateral edges.

17. An armored shirt comprising:

a front portion and a rear portion wherein the front portion and the rear portion are connected along lateral edges thereof;

shoulder portions that connect upper portions of the front and rear portions;

a neck opening defined anteriorly and posteriorly by the front and rear portions and laterally by the shoulder portions;

left and right arm openings defined by arcuate, upper edges the front and rear portions and by outer edges of the shoulder portions;

contoured body armor with a contoured edge shape;

a contoured armor pocket formed in at least the front portion or the rear portion of the armored shirt for receiving the contoured body armor wherein the pocket is formed by an inner layer of material and an outer layer of material, wherein the inner and outer layers of material are joined along lower and lateral portions of the inner and outer layers of material to define a contoured edge structure of the pocket with a shape, and wherein the inner and outer layers are not joined along an upper portion thereof thereby to leave a pocket opening;

wherein the shape of the contoured edge of the contoured body armor substantially corresponds to the shape of the contoured edge structure of the contoured armor pocket and wherein the shape of the contoured edge structure of the contoured armor pocket spans from under the left arm opening to under the right arm opening;

wherein the shape of the contoured edge structure of the contoured armor pocket is bounded by a lower edge, at lateral edges, at lateral inwardly arcuate upper narrowing underarm portions adjacent to the arm openings, and along a central upper portion between the lateral inwardly arcuate upper narrowing portions bounded by the neck opening, wherein the central upper portion of the shape of the contoured edge structure comprises the pocket opening, and wherein the shape of the contoured edge of the body armor has a lower edge, lateral edges, lateral inwardly arcuate upper narrowing underarm portions, and a central upper portion between the lateral inwardly arcuate upper narrowing portions; and armor retaining flaps within the body armor pocket;

whereby the contoured body armor can be selectively inserted into the contoured armor pocket with the contoured edge shapes of the contoured body armor and the contoured armor pocket disposed in alignment.

18. The armored shirt of claim 17 wherein the armor retaining flaps traverse longitudinally along the lateral portions of the inner and outer layers of material that define the contoured edge structure of the pocket and wherein outer edges of the armor retaining flaps are secured to lateral portions of the contoured armor pocket and along the lateral inwardly arcuate upper narrowing underarm portions of the contoured edge shape of the contoured armor pocket.

19. The armored shirt of claim 17 wherein the inner and outer layers are formed from a fabric and wherein the armor retaining flaps are formed of a flexible material having greater rigidity than the fabric forming the inner and outer layers.

20. The armored shirt of claim 17 wherein the contoured body armor is formed from a material comprising at least one of an aramid fiber cloth material or a high molecular weight polyethylene filament material in a resin matrix.

* * * * *